US006318259B1

(12) United States Patent
Chou et al.

(10) Patent No.: US 6,318,259 B1
(45) **Date of Patent: *Nov. 20, 2001**

(54) APPARATUS AND METHOD FOR LITHOGRAPHIC PRINTING UTILIZING A PRECISION EMULSION INK FEEDING MECHANISM

(75) Inventors: Shem-Mong Chou, Westmont; Thaddeus A. Niemero, Lisle; Xin Xin Wang, Naperville; Thomas W. Orzechowski, Orland Park; Joseph Vucko, Lemont, all of IL (US)

(73) Assignee: Graphic Systems, Inc., Westmont, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/923,010

(22) Filed: Sep. 3, 1997

(51) Int. Cl.[7] ..... B41F 31/02; B41F 31/08

(52) U.S. Cl. ..... 101/350.5; 101/364; 101/366; 101/450.1

(58) Field of Search ..... 101/148, 350.1, 101/350.5, 364, 366, 450.1, 451

(56) References Cited

U.S. PATENT DOCUMENTS

| | | | | |
|---|---|---|---|---|
| 2,154,544 | | 4/1939 | Taylor | 101/350 |
| 2,177,656 | | 10/1939 | Kaddeland | 101/157 |
| 2,366,375 | | 1/1945 | Worthington | 101/364 |
| 3,045,592 | | 7/1962 | Shearer et al. | 101/350 |
| 3,137,137 | | 6/1964 | Källe | 60/52 |
| 3,958,509 | | 5/1976 | Murray et al. | 101/426 |
| 4,064,801 | | 12/1977 | Switall | 101/147 |
| 4,085,672 | | 4/1978 | Grosart | 101/169 |
| 4,281,597 | * | 8/1981 | Dressler | 101/366 |
| 4,329,923 | | 5/1982 | Iida | 101/365 |
| 4,388,864 | | 6/1983 | Warner | 101/148 |
| 4,407,159 | | 10/1983 | Wytaniec | 73/290 R |
| 4,461,211 | | 7/1984 | Wesselmann et al. | 101/366 |
| 4,527,479 | | 7/1985 | Dahlgren et al. | 101/450.1 |
| 4,559,493 | | 12/1985 | Goldberg et al. | 324/61 R |
| 4,658,207 | | 4/1987 | Scribano et al. | 324/61 P |
| 4,690,055 | * | 9/1987 | Fadner et al. | 101/148 |
| 4,787,313 | | 11/1988 | Osborn et al. | 101/366 |
| 4,864,925 | * | 9/1989 | Van Kanegan et al. | 101/451 |
| 5,027,706 | * | 7/1991 | Niemiro et al. | 101/366 |
| 5,044,274 | * | 9/1991 | Gaunt | 101/451 |
| 5,088,402 | * | 2/1992 | Hycner et al. | 101/142 |
| 5,105,739 | | 4/1992 | Osawa et al. | 101/365 |
| 5,224,421 | | 7/1993 | Doherty | 101/211 |
| 5,280,750 | | 1/1994 | Yoshida et al. | 101/363 |
| 5,303,649 | | 4/1994 | Reder et al. | 101/363 |
| 5,315,930 | | 5/1994 | Niemiro | 101/366 |
| 5,372,067 | * | 12/1994 | Doyle | 101/451 |
| 5,694,974 | | 12/1997 | Niemiro et al. | 137/392 |
| 5,927,200 | * | 7/1999 | Chou et al. | 101/366 |

FOREIGN PATENT DOCUMENTS 0 355 590 2/1990 (EP) .

OTHER PUBLICATIONS

Patent Cooperation Treaty International Search Report, mailed Dec. 28, 1998, for application No. PCT/US98/18133, filed Sep. 2, 1998.

* cited by examiner

*Primary Examiner*—Stephen R. Funk
(74) *Attorney, Agent, or Firm*—Marshall, Gerstein, & Borun

(57) ABSTRACT

An apparatus and method for supplying emulsion ink to a printing plate on a printing press is disclosed. The apparatus includes an ink feed and recirculation system and associated control system to quickly and reliably form a high quality emulsion ink. The control system utilizes both feedback and feedforward control strategies. The recirculation of the emulsion ink ensures that the emulsion ink remains stable and makes it possible to reformulate the emulsion ink, if necessary, without waiting for the exhaustion of all of the emulsion ink that is in need of reformulation.

27 Claims, 9 Drawing Sheets

APPARATUS AND METHOD FOR LITHOGRAPHIC PRINTING UTILIZING A PRECISION EMULSION INK FEEDING MECHANISM

FIELD OF THE INVENTION

The present invention is generally related to a method and apparatus for lithographic printing using emulsion ink and, more particularly, a method and apparatus for feeding emulsion ink to a plate cylinder of a lithographic printing press.

BACKGROUND OF THE INVENTION

In a conventional lithographic printing process, an inking system is used to feed ink to the image areas of the printing plate and a separate dampening system is used to dampen the non-image areas of the printing plate. The water provided for dampening is more or less uniform across the press, while the ink input is regulated according to the image coverage of each printing zone and hence varies across the press. Such conventional processes have numerous drawbacks. The print quality is highly sensitive to the quality of the dampening systems, which are complex, expensive, difficult to maintain and take up valuable space. Great skill is required of the press operators to ensure that the proper ink/water ratio (i.e., ink/water balance) is maintained across the press during printing.

A relatively long start-up time is required before the ink/water balance reaches a steady state, and print quality varies during the start-up time. The time for the press to reach a steady state after a change in the ink feed rate is inversely proportional to the image coverage of each printing zone. Press operators commonly adjust the ink feed rate before the press has reached a steady state condition and hence end up chasing after a target print density constantly throughout an entire press run. This also accounts for inconsistent print quality. When the optical print density is lower than the target value, it could be caused by either insufficient ink supply or too much water supply. It requires a skilled crew to make the correct adjustment. Failure to do so may eventually result in tremendous print waste.

Ink input requirements vary across the press, which adds complexity to the printing process control, especially for a large newspaper press which may have as many as a thousand ink keys that need to be adjusted.

The aforementioned difficulties associated with presses having separate ink supply and dampening systems have prompted the development of systems using a single fluid for both inking and dampening: emulsion ink. Emulsion inks used in lithography are made from an emulsion of an oil-based ink and a water-based fountain solution. The emulsion ink is applied to a printing plate (typically mounted on a plate cylinder) having distinct image areas and non-image areas. The image areas have an oleophilic material, such as an oleophilic polymer, disposed on the surface thereof, so that the oil-based ink will adhere thereto for subsequent transfer to a printing substrate, such as a paper web. The non-image areas have a hydrophilic material, such as an aluminum oxide, disposed on the surface thereof, so that the water-based fountain solution will adhere thereto, thereby forming a protective film over the non-image areas, to prevent ink from adhering thereto. A principal advantage of the use of emulsion inks is that emulsion inks can eliminate the need for a separate system to dampen the printing plate and hence eliminates printing problems associated with keeping the ink/water properly in balance. Also, using emulsion inks simplifies the printing process by eliminating the need for many ink keys that would otherwise be required in presses using separate dampening and inking systems, i.e., to account for variations in image density.

However, a major drawback of the use of emulsion inks is that emulsion inks are often unstable (i.e. the oil-based ink and water-based fountain solution separate into distinct liquid layers). Such instability is undesirable because it interferes with ink transfer. For example, if the emulsion ink is not stable enough, the oil-based ink and water-based fountain solution will separate prematurely, before reaching the printing plate, resulting in scumming and wash marks, as water released from the emulsion ink will interfere with ink transfer by (a) reducing the amount of emulsion ink fed to the printing plate and (b) flushing across image areas of the printing plate. However, if the emulsion ink is overly stable, it will not release a sufficient amount of water to the printing plate to keep the non-image areas of the printing plate free of ink. Accordingly, the emulsion ink is formulated to have a stability that is within a "window" between being too stable and too unstable for satisfactory lithographic printing. It has been found that suitable emulsion inks have a water content of at least 35% by weight.

Also, because the viscosity of lithographic inks is relatively high, about 10 to a few hundred poises, lithographic inks generally do not flow freely. As water is dispersed into a matrix of lithographic ink to produce emulsion inks, the flow properties further deteriorate, making the formation of a suitably stable emulsion ink difficult.

Accordingly, when using emulsion ink, it is often necessary to adjust the ink/water balance during operation of the printing press. With existing press configurations, the adjustment will not take effect until the emulsion ink needing adjustment is substantially used up.

SUMMARY OF THE INVENTION

It is an object of the present invention to provide a method and apparatus for feeding emulsion ink to a lithographic printing plate. Specifically, it is an object of the present invention to provide a method and apparatus for applying a highly precise mixture and amount of emulsion ink to a lithographic printing plate.

In accordance with one aspect of the present invention, an emulsion ink reconstitution and recirculation apparatus for a lithographic printing press having a plate cylinder comprises: a device for forming an emulsion ink; a device for applying the emulsion ink to the plate cylinder; a device for supplying the emulsion ink to the ink distribution rail; and a device for recirculating the emulsion ink from the ink distribution rail to the emulsion ink forming device.

Other objects, advantages, and features of the present invention will become apparent from a consideration of the following specification taken in conjunction with the accompanying drawings.

DETAILED DESCRIPTION OF THE PREFERRED EMBODIMENTS

Figure 1:
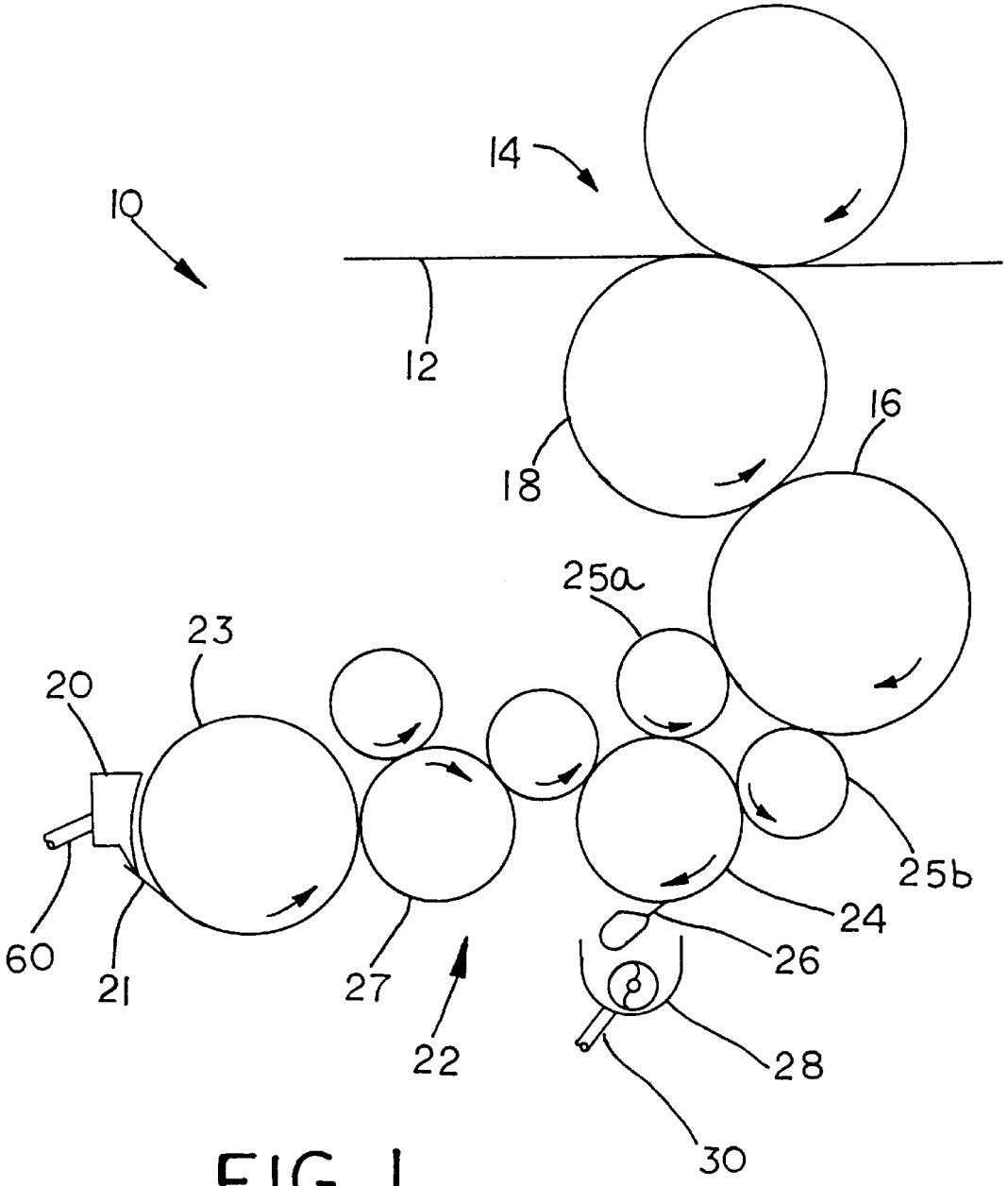
FIG. 1 is a schematic diagrammatic view of a printing press incorporating a precision emulsion ink feeding mechanism in accordance with the present invention.

In the illustrations given, and with reference first to FIG. 1, there is shown a printing press generally designated 10 for printing an image on a paper web 12. The press 10 has a printing unit 14 for printing ink on the web 12. Although not shown, the press 10 may include one or more additional printing units that may each be used, for example, for printing a different color of ink on the web 12.

The printing unit 14 has a plate cylinder 16 associated with a blanket cylinder 18. During printing by the press 10, an image of the ink is transferred from the plate cylinder 16 to the blanket cylinder 18 to print the image on one surface of the web 12. An emulsion ink, made up of an oilbased ink and a water-based fountain solution, is fed to the plate cylinder 16 from a digitally-controlled gear pump ink injector unit 20 through a plurality of distribution rollers 22, including a fountain roller 23, an auxiliary vibrator drum 27, a vibrator/scraper drum 24, and a pair of form rollers 25*a* and 25*b*. A smoothing blade 21 is mounted to the gear pump injector unit 20 and contacts the surface of the fountain roller 23 in order to evenly spread the emulsion ink onto the fountain roller 23. The surface of the fountain roller 23 is covered with a brush surface made from a material available commercially as Part No. 2A3 from Kanebo USA Inc., 693 5th Avenue, 17th Floor, New York, N.Y. 10022. This material is similar to the "loop" portion of so-called "hook and loop" fasteners, such as VELCRO®. The vibrator/scraper drum 24 has a wear-resistant, oleophilic/hydrophobic surface that collects excess emulsion ink that is in turn scraped off of the vibrator/scraper drum 24 by a doctor blade 26 and collected for re-use by an auger and scraper assembly 28, forming part of an ink feed and recirculation system 29, shown schematically in FIG. 2. The auxiliary vibrator drum 27 and the vibrator/scraper drum 24 oscillate in an axial direction (i.e., in a direction perpendicular to the plane of the paper in FIG. 1) to help ensure that a uniform emulsion ink film is supplied to the plate cylinder 16 and to prevent the formation of ridges on the emulsion ink film.

The fountain roller 23 rotates at a maximum speed of about 60 revolutions per minute, and proportionally slower as press speed is slowed. The rotation of the fountain roller 23 is thus quite slow in comparison to the rotation of the auxiliary vibrator drum 27, which typically rotates at a speed of about 1,000 revolutions per minute when the press 10 is operating.

The inking rollers (i.e. the fountain roller 23, the form rollers 25*a*, 25*b*, and those rollers therebetween) are driven by a separate motor so that the inking rollers may be driven while the plate cylinder 16 and the blanket cylinder 18 are stationary. Therefore, the inking rollers may be driven at press startup until an acceptable emulsion ink has been formed by the ink feed and recirculation system 29, thereby minimizing print waste during press startup.

Figure 2:
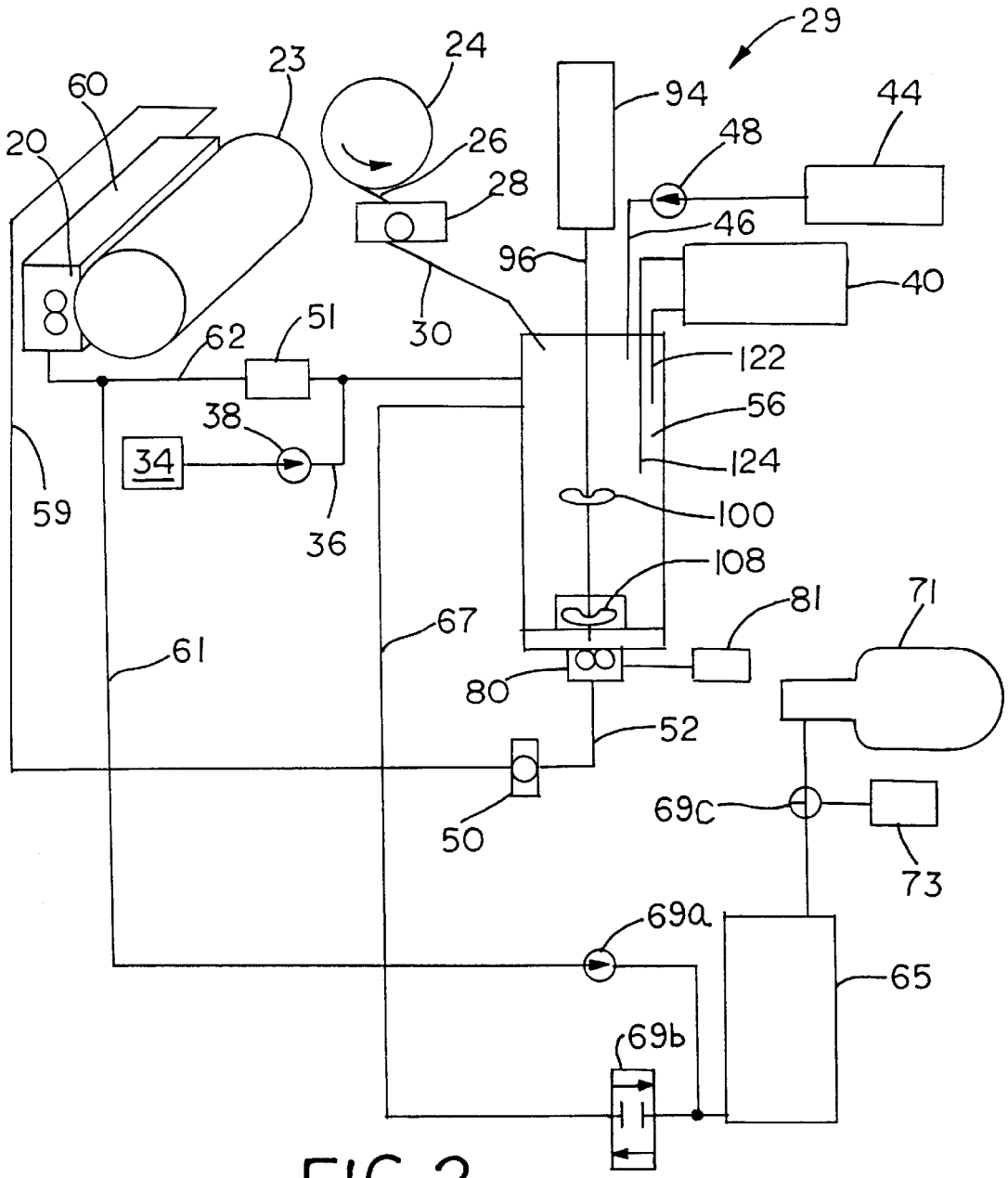
FIG. 2 is a schematic diagrammatic view of the emulsion ink feeding mechanism.

With reference to FIG. 2, the collected excess ink is transported by the auger and scraper assembly 28 to a conduit 30 which feeds a mixing and dispersing apparatus 56. Fresh ink is fed to the mixing and dispersing apparatus 56 from an ink supply reservoir 34 through a conduit 36. The flow of fresh ink through the conduit 36 is controlled by a new ink valve 38 that is responsive to a liquid level sensor 40 that senses the level of liquid in the mixing and dispersing apparatus 56. If the liquid level sensor 40 determines an overflow level of liquid, emulsion ink via conduit 62 is diverted to a conduit 61 and into an auxiliary reservoir 65. Liquid from the auxiliary reservoir 65 may be used again by feeding it back to the mixing and dispersing apparatus 56 via a conduit 67. Liquid discharge into or out of the auxiliary reservoir 65 is controlled via solenoid valves 69*a*, 69*b*, and 69*c* and by air depressurizing (discharge into) or air pressurizing (discharge out of) the auxiliary reservoir 65. The solenoid valve 69*c* can connect the auxiliary reservoir 65 to either a shop air system 71, providing air pressure of from about 40 psi (about 276 kPa) to about 70 psi (about 483 kPa), for pressurizing the auxiliary reservoir 65, or an ambient air source 73, providing air at an ambient pressure of about 14.7 psi (about 101 kPa), for depressurizing the auxiliary reservoir 65. If desired, a vacuum source may be substituted for the ambient air source 73, in order to provide air at an even lower pressure.

Fresh fountain solution (or clean water, as the case may be) is fed to the mixing and dispersing apparatus 56 from a fountain solution supply reservoir 44 through a conduit 46. The flow of fresh fountain solution through the conduit 46 is controlled by a valve 48 that is responsive to a water content sensor 50 that senses the percentage of water flowing out of the mixing and dispersing apparatus 56 in an outlet conduit 52. The emulsion ink is fed to an ink distribution rail 60 via a conduit 59. The ink distribution rail 60 in turn feeds the digitally-controlled gear pump ink injector unit 20. Unused emulsion ink is continuously recirculated to the mixing and dispersing apparatus 56 via the return conduit 62. This continuous recirculation of unused emulsion ink via the return conduit 62 is in addition to the ink scraped off of the vibrator/scraper drum 24 and returned to the mixing and dispersing apparatus 56 via the conduit 30. The continuous recirculation of emulsion ink ensures that the emulsion ink remains stable and makes it possible to reformulate the emulsion ink, if necessary (i.e. if the water content thereof is too low or too high), without having to wait for the exhaustion of all of the emulsion ink that is in need of reformulation. This dramatically reduces the amount of print waste due to poorly formulated emulsion ink.

A restriction valve 51 ensures that the pressure in the conduit 62 is between about 10 psi (about 69 kPa) and about 20 psi (about 138 kPa). The restriction valve 51 ensures that there is adequate pressure in the ink distribution rail 60 and adequate pressure for filling the auxiliary reservoir 65, when necessary.

Figure 3:
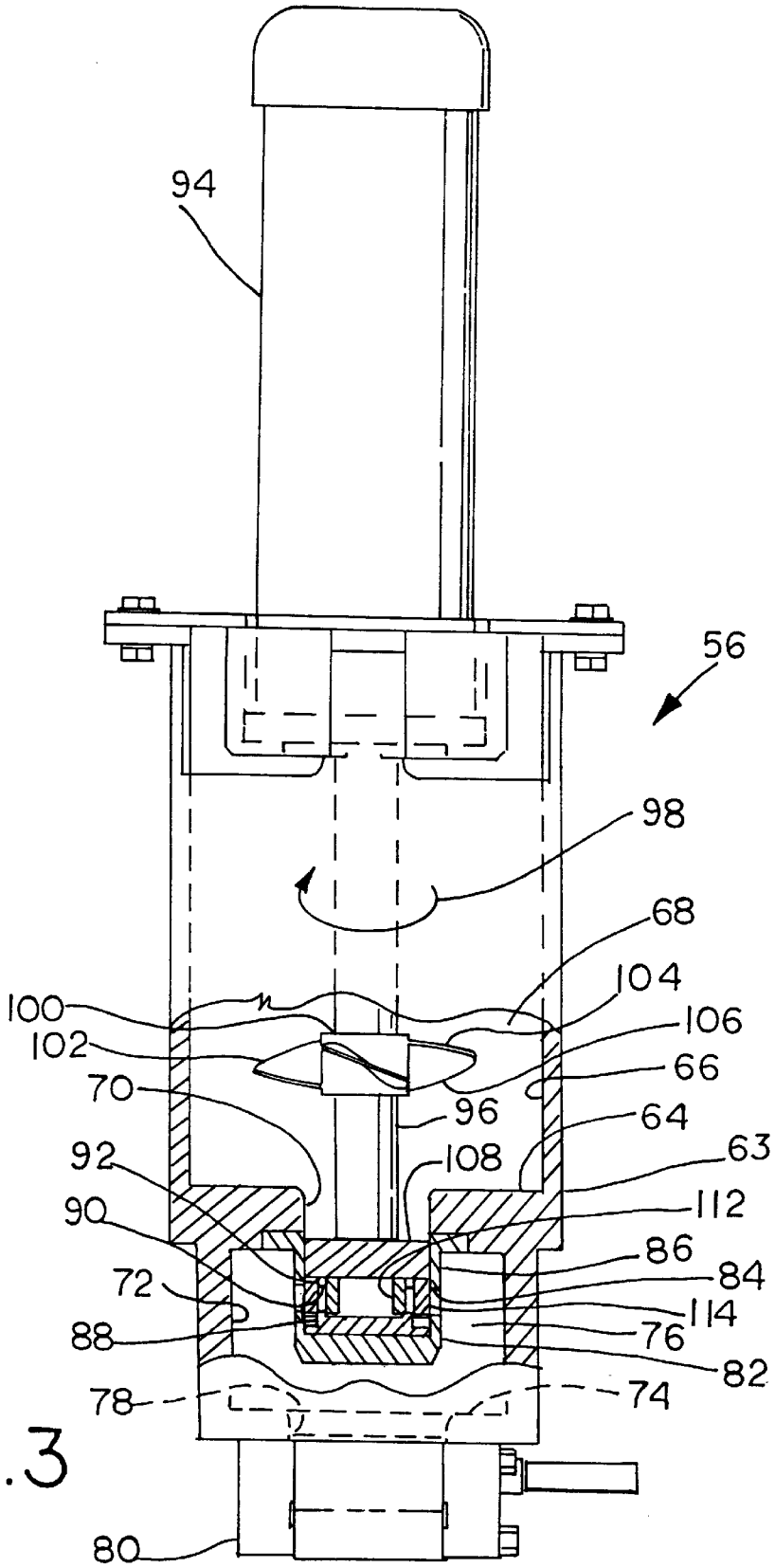
FIG. 3 is a side elevational view, partially in cross-section, of a liquid mixing and dispersing apparatus forming part of the emulsion ink feeding mechanism.
Figure 5:
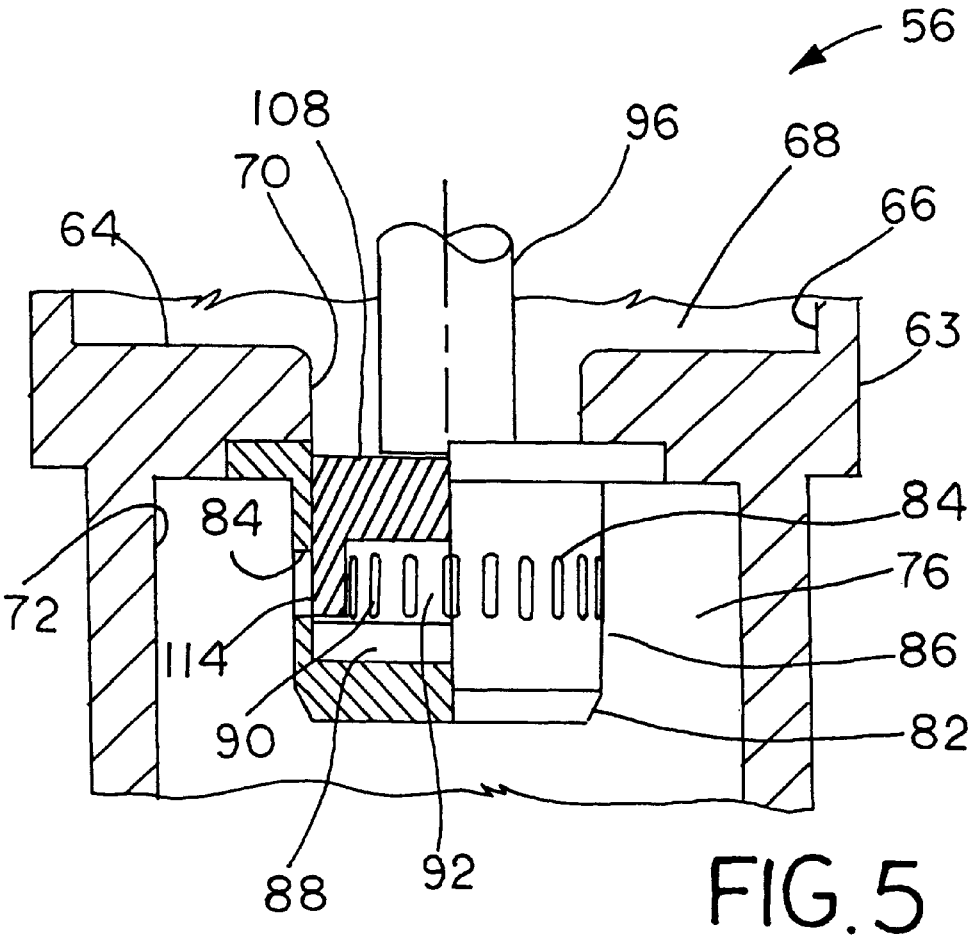
FIG. 5 is a fragmentary side elevational view showing the rotor, the inner stator member, and the outer stator member, partially in cross-section taken generally along lines 5—5 of FIG. 4.

With reference to FIGS. 3 and 5, the mixing and dispersing apparatus 56 includes a vessel 63 comprising a first circular horizontal wall 64, and a cylindrically-shaped upper vertical wall 66 having a height of about 21.0 cm and an inner diameter of about 17.8 cm, that together define a cylindrically-shaped upper chamber 68.

The first horizontal wall 64 has a circular opening 70 therein having a diameter of about 6.4 cm. The vessel 63 also includes a cylindrically-shaped lower vertical wall 72 having an inner diameter of about 13.8 cm, that is disposed directly below the first horizontal wall 64. The first horizontal wall 64, the cylindrically-shaped lower vertical wall 72, and a second circular horizontal wall 74, together define a cylindrically-shaped lower chamber 76. The second circular horizontal wall 74 has a substantially square-shaped opening 78 therein, having dimensions of about 8.0 by 8.0 cm, that leads to a gear pump 80, driven by a motor 81 (FIG. 2), that pumps emulsion ink out of the lower chamber 76.

A cup-shaped outer stator 82 is fixedly attached to the first horizontal wall 64 and is perforated by twenty four vertical slots 84 evenly distributed about an outer stator cylindrical wall 86, having a wall thickness of about 4.8 mm. A cup-shaped inner stator 88 is fixedly attached to the outer stator 82 and is perforated by sixteen vertical slots 90 evenly distributed about an inner stator cylindrical wall 92, having a wall thickness of about 4.0 mm. Each of the slots 84 and 90 has a height of about 15.9 mm and a width of about 3.4 mm.

A high-speed electric motor 94 is disposed above the upper chamber 68 and drives a motor shaft 96 in a clockwise direction as viewed from above, as indicated by an arrow 98. A propeller 100 is mounted to the motor shaft 96 for rotation therewith and comprises three propeller blades 102 equally angularly spaced apart from one another by 120 degrees and each pitched by an angle of about 20 degrees with respect to the horizontal such that a leading edge 104 of each propeller blade 102 is above a respective trailing edge 106 of each propeller blade 102. The propeller 100 has a diameter of about 12.7 cm and is mounted to the motor shaft 96 in the upper chamber 68 at a location that is preferably between one half to one full propeller diameter above the first horizontal wall 64.

Figure 4:
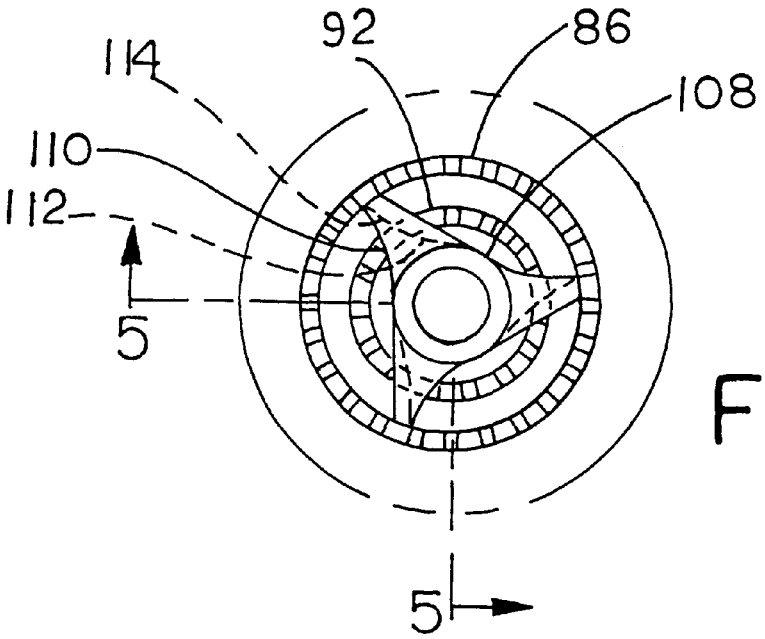
FIG. 4 is a plan view showing a rotor, an inner stator member, and an outer stator member forming part of the liquid mixing and dispersing apparatus.
Figure 6:
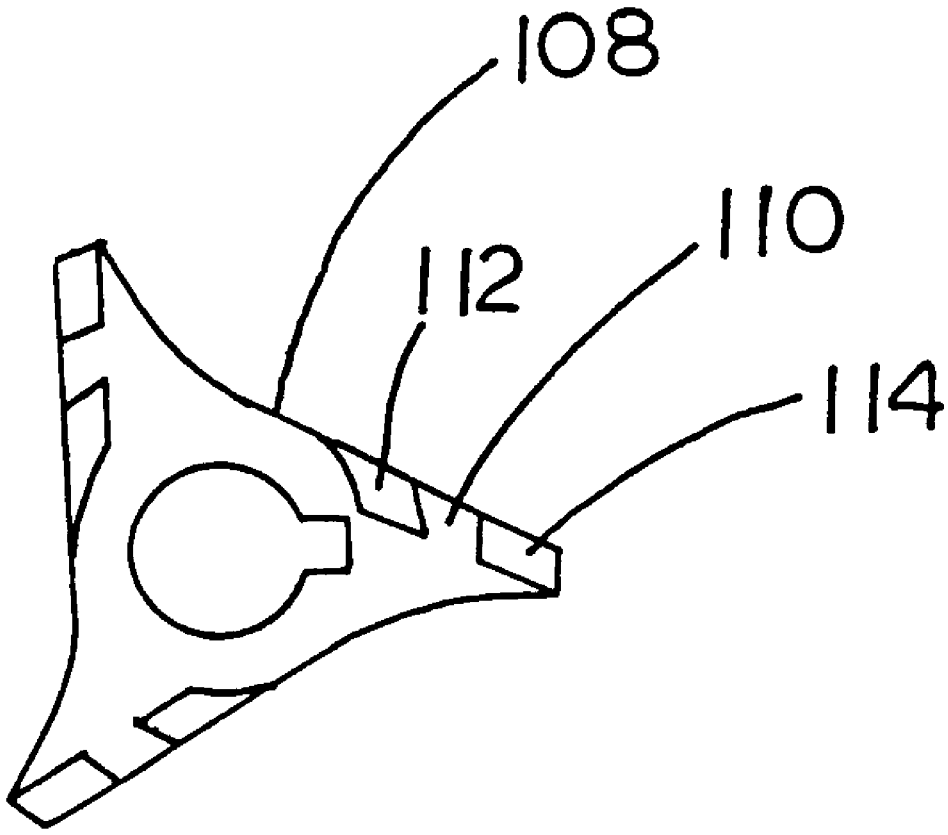
FIG. 6 is an elevational view, taken from below, showing the rotor.

A rotor 108 (best seen in FIGS. 4 and 6) is mounted to the lower end of the motor shaft 96 for rotation therewith. The rotor 108 includes three horizontal blades 110 that are equally angularly spaced apart from one another by 120 degrees. Each blade 110 includes a downwardly extending inner tooth 112 and a downwardly extending outer tooth 114. Each inner tooth 112 is disposed radially inwardly of the inner stator wall 92 and each outer tooth 114 is disposed between the inner stator wall 92 and the outer stator wall 86. A relatively close clearance of about 0.4 mm is provided between the teeth 112, 114 and the stator walls 86, 92.

In operation, the motor 94 is rotated at a speed of between about 500 and about 4,000 revolutions per minute, and the motor shaft 96, the rotor 108, and the propeller 100 rotate at the same speed as the motor 94. Due to the pitch of the propeller blades 102, the rotation of the propeller 100 causes the ink and fountain solution in the upper chamber 68 to mix together and to flow downwardly toward the rotor 108. The rotation of the rotor 108 shears the ink and fountain solution between the rotor teeth 112, 114 and the inner and outer stator walls 92 and 86. This shearing causes the formation of a fine emulsion ink that is dispersed through the slots 90 and 84 in the inner and outer stator walls 92 and 86 into the lower chamber 76. The emulsion ink is then pumped by the gear pump 80 to the conduit 52 (FIG. 2).

The propeller 100 pre-mixes the ink and fountain solution together and ensures that the fountain solution added to the upper chamber 68 does not simply sit on top of the ink surface and fail to mix with the ink matrix to form an emulsion ink having the desired water content. The propeller 100 also prevents a cavity from forming above the rotor 108, that would inhibit ink and fountain solution from flowing into the lower chamber 76.

Figure 7:
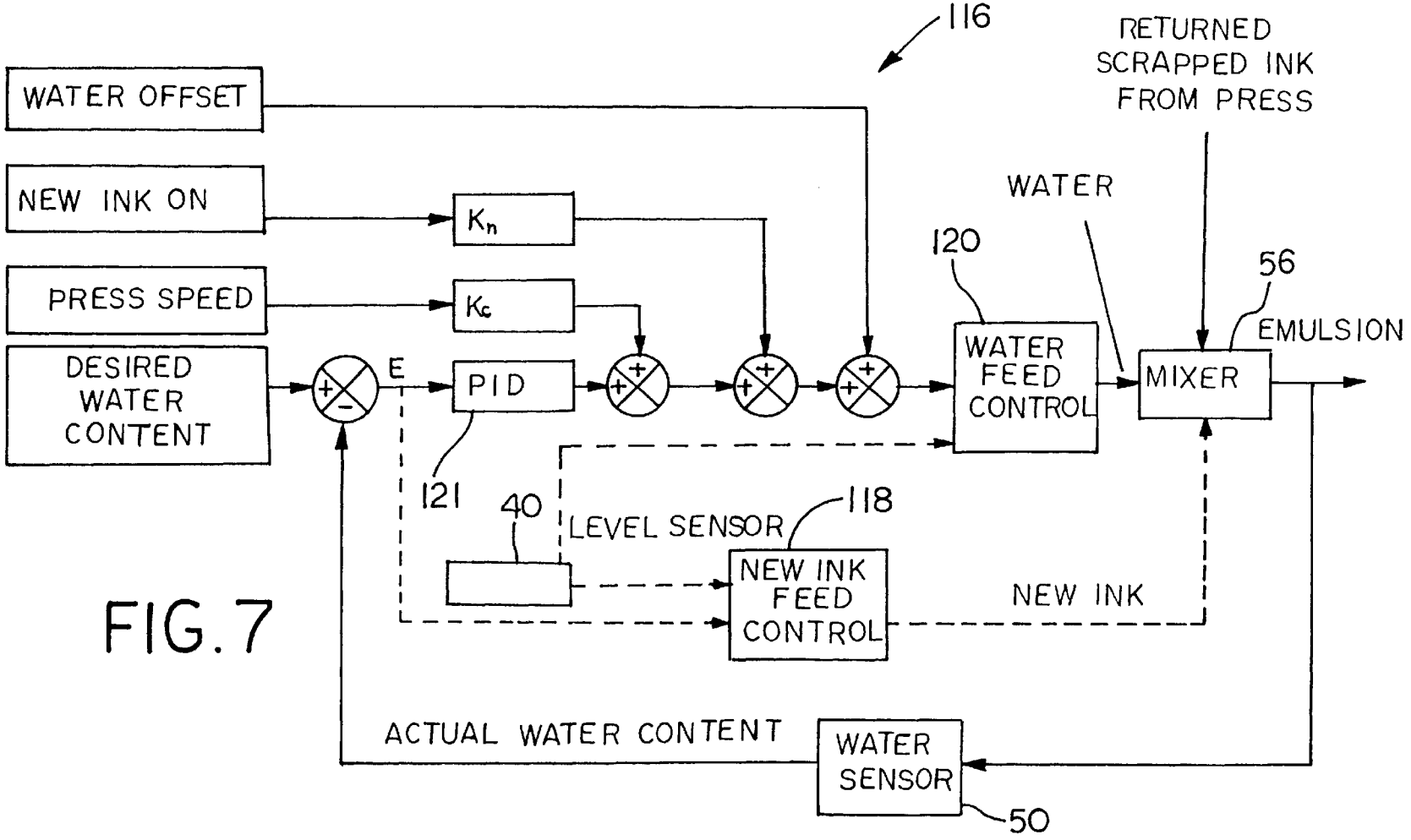
FIG. 7 is a schematic diagrammatic view of a control system for regulating the emulsion ink composition for the precision emulsion ink feeding mechanism.

With reference to FIG. 7, an electronic control system 116, for regulating the emulsion ink composition for the precision emulsion ink feeding mechanism, comprises a new ink controller 118 and a water content controller 120.

The control system 116 ensures that the liquid level in the mixing and dispersing apparatus 56 is maintained at an acceptable level. The control system 116 comprises the liquid level sensor 40 that includes an overflow sensor 122 and a minimum liquid level sensor 124, both of which are shown schematically in FIG. 2. New ink and/or fountain solution is added to the mixing and dispersing apparatus 56 from the ink supply reservoir 34, the fountain solution supply reservoir 44 and/or the auxiliary reservoir 65 if the liquid level in the mixing and dispersing apparatus 56 is too low, and emulsion ink is discharged from the mixing and dispersing apparatus 56 to the auxiliary reservoir 65 if the liquid level in the mixing and dispersing apparatus 56 is too high. Emulsion ink may also be discharged from the mixing and dispensing apparatus 56 to the auxiliary reservoir 65 if the water content of the emulsion ink is out of tolerance, so that either fresh ink or fountain solution can be added to the mixing and dispersing apparatus 56 from the ink supply reservoir 34 or the fountain solution supply reservoir 44, respectively, to quickly reformulate the emulsion ink without overflowing the mixing and dispersing apparatus 56.

The water content controller 120 uses both feedback and feedforward control strategies. The feedback control strategy is based on the difference between the desired water content value and the actual water content value, as sensed by the water content sensor 50, generating an error signal, E, which is input into a PID (proportional, integration, differentiation) controller 121.

The feedforward control strategy includes an input $K_n$, based on the status of the new ink valve 38, an input $K_s$, based on the press speed, and a water offset input that accounts for evaporation. The input $K_n$ accounts for the fact that, when the new ink valve 38 is open, fresh ink is being fed to the mixing and dispersing apparatus 56. The input $K_s$ accounts for the fact that, as press speed goes up, more scraped ink will be fed to the mixing and dispersing apparatus 56. The feedforward control strategy therefore anticipates the expected requirements for fountain solution and minimizes the error, E, that needs to be resolved by the PID controller 121. Accordingly, response time for necessary adjustments to the emulsion ink is minimized.

The operation of the water content controller 120 is also regulated by the new ink controller 118. For example, when the ink level is low, fresh ink will be pumped into the mixing and dispersing apparatus 56. This action will lower the water content of the emulsion ink in the ink feed and recirculation system 29. Hence, more water has to be pumped into the ink feed and recirculation system 29 to maintain a constant level of water content.

Figure 8:
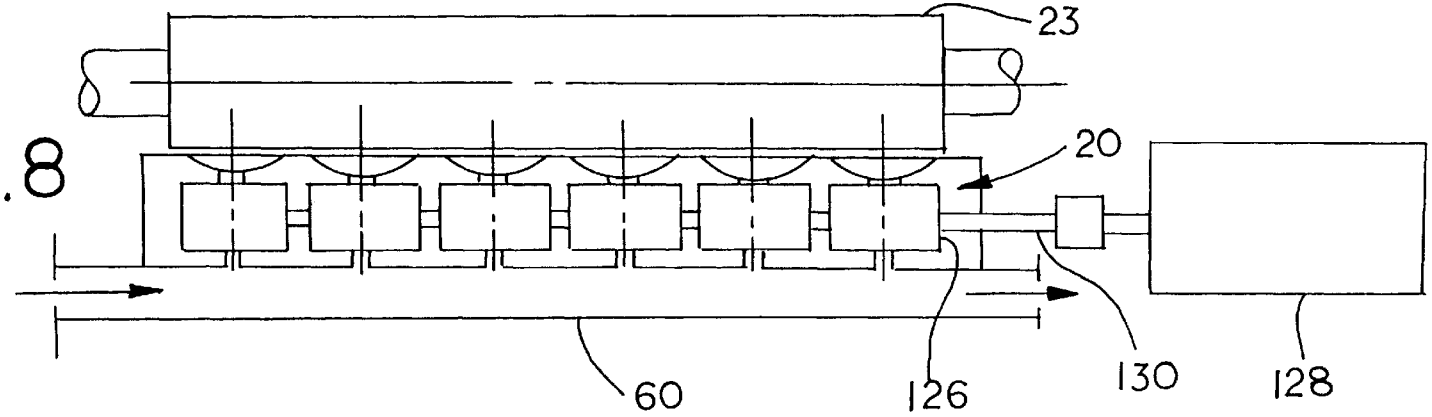
FIG. 8 is a schematic diagrammatic view of an ink distribution rail and fountain roller assembly forming part of the precision emulsion ink feeding mechanism.
Figure 9:
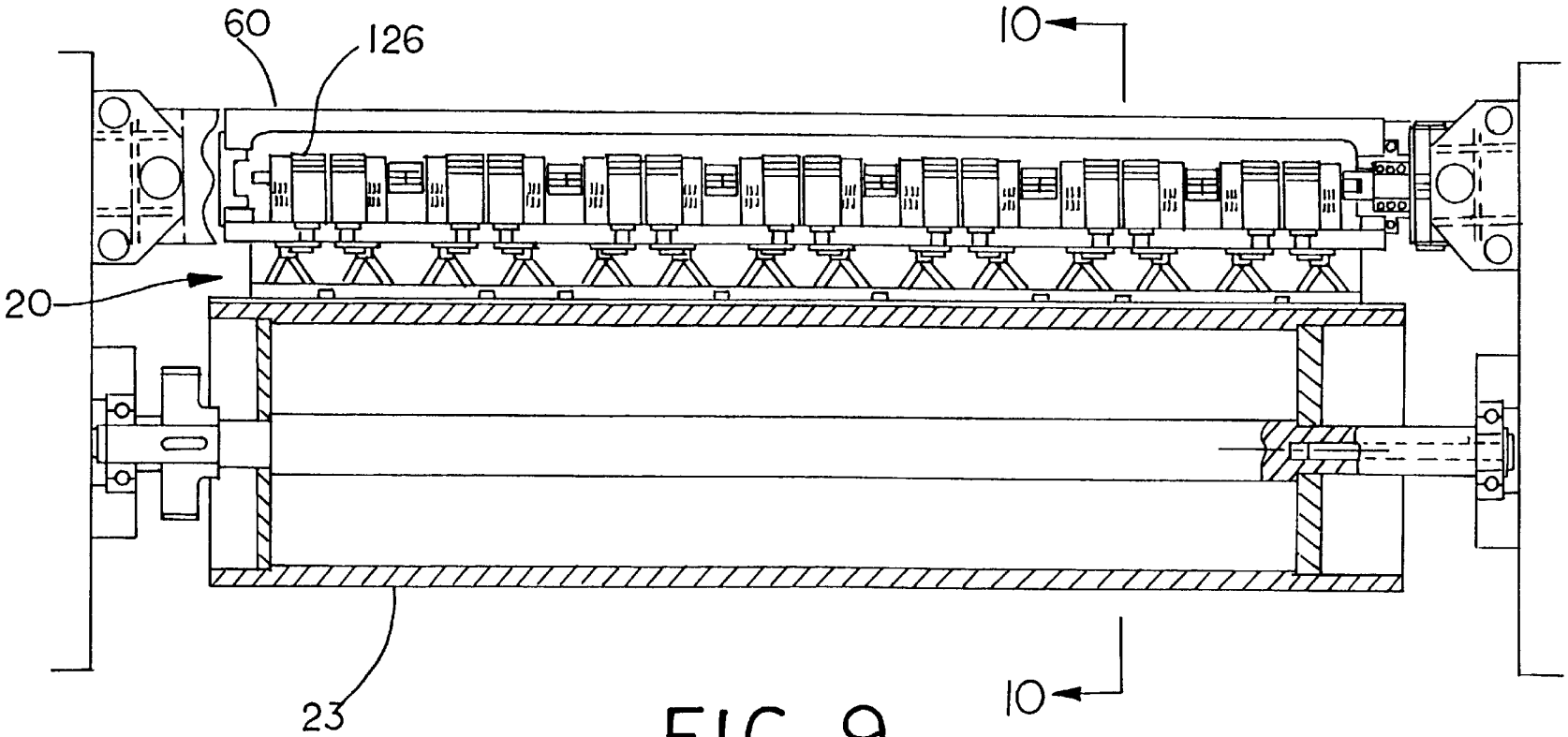
FIG. 9 is a plan view, partially in cross-section, of the ink distribution rail and fountain roller of FIG. 8.
Figure 10:
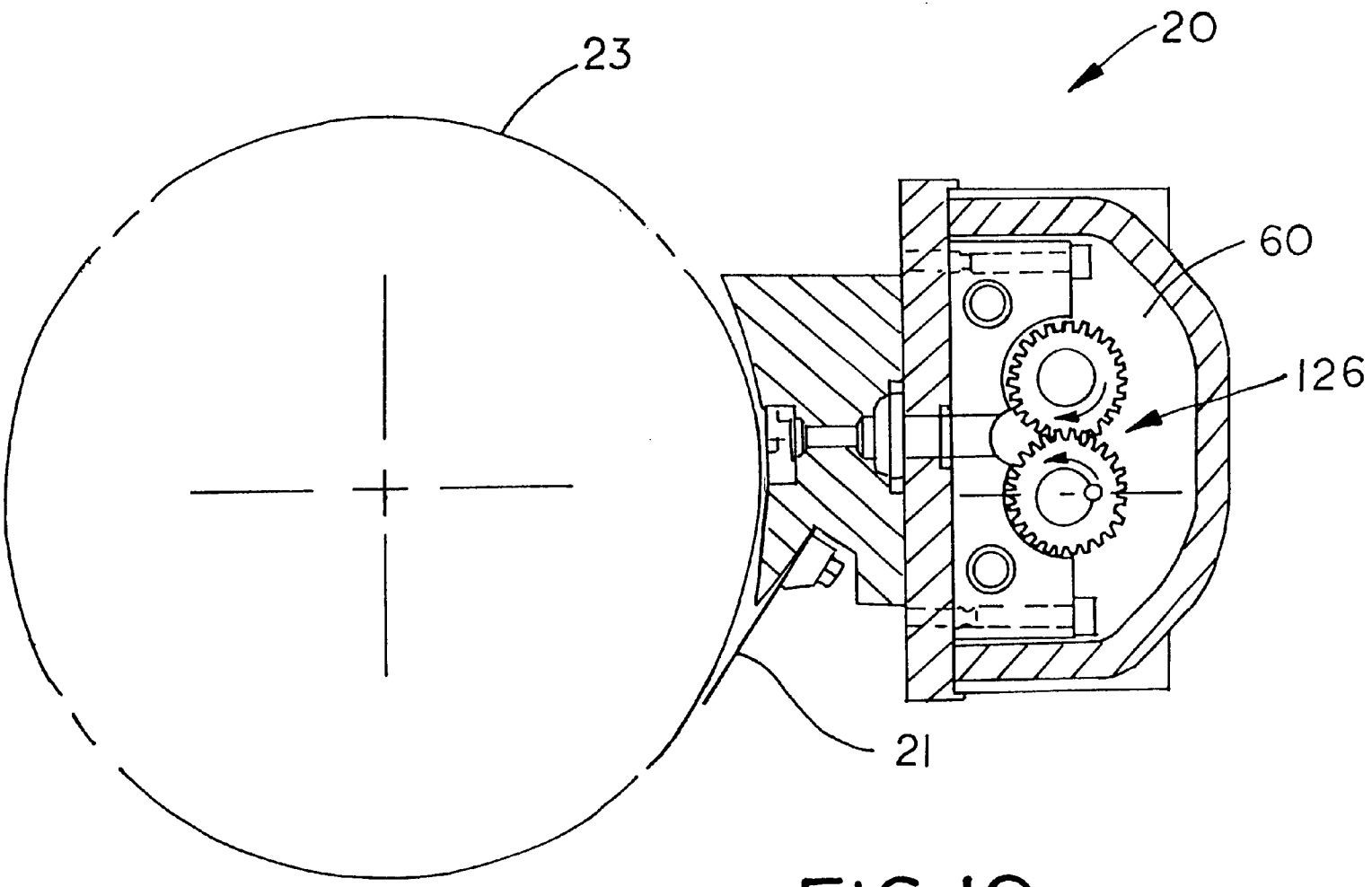
FIG. 10 is a cross-sectional view, taken generally along lines 10—10 of FIG. 9, of the ink distribution rail.

With reference to FIGS. 8–10, the digitally-controlled gear pump ink injector unit 20 comprises a plurality of positive displacement gear pumps 126 mounted within the ink distribution rail 60. The positive displacement gear pumps 126 are driven by a single electric motor 128 by means of a single drive shaft 130. The positive displacement gear pumps 126 can be precisely controlled electronically, thereby providing optimal coverage of the fountain roller 23 with emulsion ink and providing the capability, for example, to proportionally control the flow rate through the positive displacement gear pumps 126 based on press speed. This makes it unnecessary to rely on a metering roll to achieve optimal coverage of the plate cylinder 16, and makes the printing press 10 reach a steady state fairly quickly.

Figure 11:
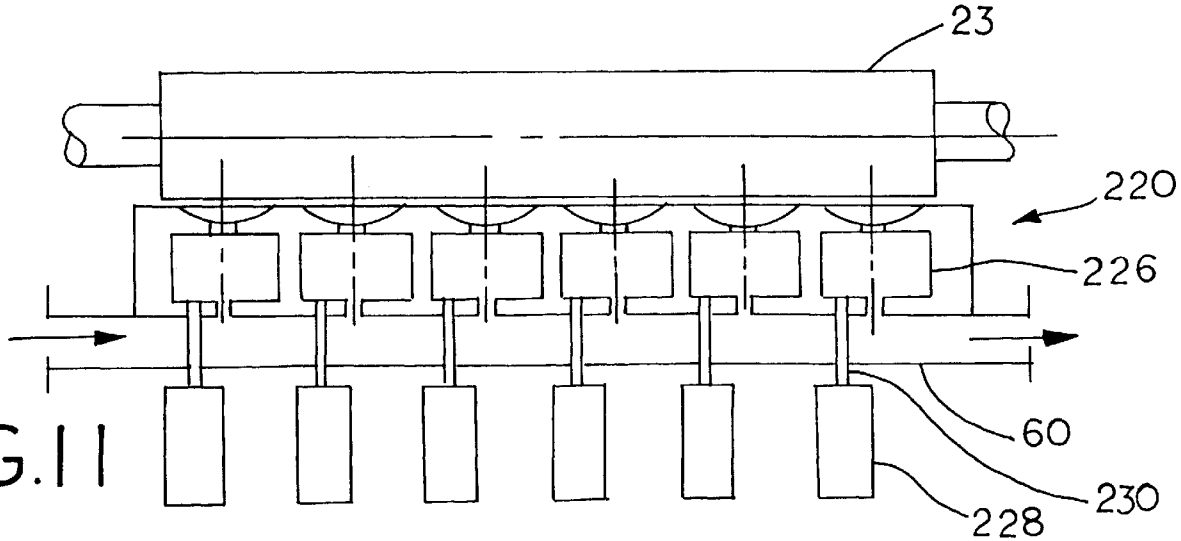
FIG. 11 is a schematic diagrammatic view of an alternative ink distribution rail and fountain roller assembly.

In an alternative embodiment of the invention, shown schematically in FIG. 11, a proportionally-controlled positive displacement pump ink injector unit 220 comprises a plurality of positive displacement pumps 226 mounted within the ink distribution rail 60. Each of the positive displacement pumps 226 is independently driven by a separate digitally-controlled electric motor 228 by means of a separate drive shaft 230, in order to allow a marginal differentiation of the ink feed rate of the positive displacement pumps 226, for example, to compensate for the effects of what are commonly known as starvation and ghosting.

While in the foregoing there has been set forth a preferred embodiment of the invention, it will be appreciated that the details herein given may be varied by those skilled in the art without departing from the true spirit and scope of the appended claims. For example, each of the positive displacement gear pumps 126 may instead be any suitable positive displacement pump, such as a diaphragm pump, a reciprocating piston pump, a moving vane pump, or a lobe pump.

We claim:

1. An emulsion ink reconstitution and recirculation apparatus for a lithographic printing press having a plate cylinder and at least one ink distribution roller, the apparatus comprising:

means for forming an emulsion ink, the forming means including a reservoir;

means for applying the emulsion ink to the plate cylinder, the applying means including an ink distribution rail;

means for supplying the emulsion ink from the forming means to the ink distribution rail; and means for recirculating unused emulsion ink from the ink distribution rail to the forming means, said recirculating means including means for continuously recirculating unused ink upstream of each said ink distribution roller; and reformulation means associated with the forming means for reformulating the emulsion ink in the reservoir of the forming means, the reformulation means including an auxiliary reservoir separate from the reservoir of the forming means and being arranged to supply emulsion ink from the auxiliary reservoir to the reservoir of the forming means and further being arranged to receive at least one of a portion of the emulsion ink from the reservoir of the forming means and a diverted portion of the unused emulsion ink from the ink distribution rail.

2. The emulsion ink reconstitution and recirculation apparatus of claim 1, further including means for returning excess scraped emulsion ink to the forming means.

3. The emulsion ink reconstitution and recirculation apparatus of claim 1, wherein the applying means comprises a positive displacement pump.

4. The emulsion ink reconstitution and recirculation apparatus of claim 3, wherein the positive displacement pump is disposed within the ink distribution rail.

5. The emulsion ink reconstitution and recirculation apparatus of claim 1, wherein the applying means comprises a plurality of positive displacement pumps.

6. The emulsion ink reconstitution and recirculation apparatus of claim 5, wherein each positive displacement pump is disposed within the ink distribution rail.

7. The emulsion ink reconstitution and recirculation apparatus of claim 5, wherein each positive displacement pump is driven by an independent motor.

8. The emulsion ink reconstitution and recirculation apparatus of claim 5, wherein at least two of the positive displacement pumps are driven by a single motor.

9. The emulsion ink reconstitution and recirculation apparatus of claim 8, wherein all of the positive displacement pumps are driven by a single motor.

10. The emulsion ink reconstitution and recirculation apparatus of claim 5, wherein each positive displacement pump is driven by an independent electric motor.

11. The emulsion ink reconstitution and recirculation apparatus of claim 5, wherein at least two of the positive displacement pumps are driven by a single electric motor.

12. The emulsion ink reconstitution and recirculation apparatus of claim 11, wherein all of the positive displacement pumps are driven by a single electric motor.

13. A method for providing emulsion ink to a lithographic printing press having a printing plate, at least one ink distribution roller and an ink rail, the method comprising the steps of:

providing an apparatus for forming an emulsion ink;

providing an ink source operatively connected to the forming apparatus;

providing a fountain solution source operatively connected to the forming apparatus;

forming the emulsion ink;

supplying the emulsion ink to the ink rail;

continuously recirculating, upstream of the at least one ink distribution roller, a first unused portion of the emulsion ink in the ink rail from the ink rail to the forming apparatus;

applying a second portion of the emulsion ink to the printing plate; and supplying an auxiliary reservoir system, the auxiliary reservoir system being operatively connected to the forming apparatus and being arranged to permit reformulation of the emulsion ink in the forming apparatus.

14. For use with a lithographic printing press having a plate cylinder and at least one ink distribution roller, an apparatus for reconstituting and recirculating an emulsion ink solution comprising:

a mixing device adapted to form the emulsion ink solution, the mixing device having an internal first reservoir and an output, the mixing device further being in flow communication with an ink source and a fountain solution source;

an auxiliary second reservoir in flow communication with the first reservoir;

a distribution rail adapted to apply the emulsion ink solution to the ink distribution roller for ultimate application to the plate cylinder, the distribution rail having an input and an output;

a supply conduit operatively connecting the mixing device output to the distribution rail input and being arranged to supply the emulsion ink solution to the distribution rail;

a return conduit operatively connecting the distribution rail output to the mixing device and being arranged to recycle an excess portion of the emulsion ink solution to the mixing device;

a discharge conduit operatively connecting the first reservoir to the second reservoir;

whereby the excess portion of the emulsion ink solution is recycled to the mixing device for re-use and further whereby the constituency of the emulsion ink solution may be rapidly re-formulated by discharging emulsion ink solution from the first reservoir to the auxiliary reservoir so that a desired amount of ink or fountain solution may be injected into the mixing device.

15. The apparatus of claim 14, including a liquid level sensor operatively connected to the mixing device and being adapted to detect a maximum level condition and a minimum level condition in the first reservoir.

16. The apparatus of claim 14, including a diverter conduit operatively connecting the return conduit to the auxiliary reservoir, the diverter conduit being arranged to divert the excess portion of the emulsion ink solution to the auxiliary reservoir.

17. The apparatus of claim 14, including a valve system, a liquid level sensor operatively connected to the mixing device and being adapted to detect a maximum level condition and a minimum level condition of the emulsion ink solution in the first reservoir, and a diverter conduit operatively connecting the return conduit to the auxiliary reservoir and being arranged to divert the excess portion of the emulsion ink solution to the auxiliary reservoir, the valve system being arranged to control the level of emulsion ink solution in the first reservoir by selectively routing emulsion ink solution into or out of the mixing device.

18. The apparatus of claim 17, wherein the valve system includes a first valve disposed in the discharge conduit and a second valve disposed in the diverter conduit.

19. The apparatus of claim 18, including an air supply adapted to supply high pressure air and low pressure air, and wherein the valve system includes a third valve operatively connecting the air supply to the auxiliary reservoir.

20. The apparatus of claim 19, wherein the third valve is shiftable between a high pressure position in which high pressure air is supplied to the auxiliary reservoir thereby routing emulsion ink solution from the auxiliary reservoir into the first reservoir, and a low pressure position in which low pressure air is supplied to the auxiliary reservoir thereby drawing emulsion ink solution into the auxiliary reservoir from the first reservoir.

21. The apparatus of claim 14, including a water content sensor disposed in the supply conduit, and further including a water content controller arranged to control the constituency of the emulsion ink solution, the water content controller being operatively connected to the ink source and the fountain solution source.

22. The apparatus of claim 21, wherein the water content controller is a PID controller.

23. For use with a lithographic printing press having a plate cylinder and at least one ink distribution roller, an apparatus for reconstituting and recirculating an emulsion ink solution comprising:

a mixing device adapted to form the emulsion ink solution, the mixing device having an internal first reservoir and an output, the mixing device further being in flow communication with an ink source and a fountain solution source;

an auxiliary second reservoir in flow communication with the first reservoir;

a distribution rail adapted to apply the emulsion ink solution to the ink distribution roller for ultimate application to the plate cylinder, the distribution rail having an input and an output;

a conduit system including a supply conduit operatively connecting the mixing device output to the distribution rail input for supplying the emulsion ink solution to the distribution rail input, a return conduit operatively connecting the distribution rail output to the mixing device first reservoir for returning an excess portion of the emulsion ink solution to the mixing device for reuse, and an auxiliary conduit operatively connecting the mixing device first reservoir and the auxiliary reservoir;

a valve system operatively connected to the conduit system; and a control system including a water content sensor disposed in the supply conduit, the control system being operatively connected to each of the valve system, the ink source and the fountain solution source, whereby the constituency of the emulsion ink solution may be rapidly re-formulated by discharging emulsion ink solution from the first reservoir to the auxiliary reservoir and by injecting a desired quantity of ink or fountain solution into the mixing device.

24. The apparatus of claim 23, wherein the conduit system further includes a diverter conduit for diverting the excess portion directly to the auxiliary reservoir.

25. The apparatus of claim 24, wherein the control system includes a PID controller.

26. The apparatus of claim 23, including a liquid level sensor operatively connected to the mixing device and being adapted to detect a maximum level condition and a minimum level condition in the first reservoir.

27. A method for providing an emulsion ink solution to a distribution rail of a lithographic printing press, the method comprising the steps of:

forming in a mixing device the emulsion ink solution from an ink supply and a fountain solution supply, the mixing device having an internal first reservoir and an output;

providing an auxiliary second reservoir in flow communication with the first reservoir;

providing a supply conduit for supplying the emulsion ink solution to an input on the distribution rail, the distribution rail further having an output;

continuously monitoring the actual constituency of the emulsion ink solution;

returning an excess portion of the emulsion ink solution from the distribution rail output to the first reservoir;

establishing a desired constituency for the emulsion ink solution; and selectively re-formulating the actual constituency of the emulsion ink solution to match the desired constituency by discharging emulsion ink solution from the first reservoir to the auxiliary second reservoir and by injecting a desired quantity of ink or fountain solution into the mixing device.

* * * * *